US005150531A

United States Patent [19]

Meglio

[11] Patent Number: 5,150,531

[45] Date of Patent: Sep. 29, 1992

[54] SLUDGE DRYING APPARATUS AND METHOD

[75] Inventor: William J. Meglio, Monroeville, Pa.

[73] Assignee: Keystone Rustproofing, Inc., Arnold, Pa.

[21] Appl. No.: 710,540

[22] Filed: Jun. 5, 1991

[51] Int. Cl.[5] ..... F26B 3/22

[52] U.S. Cl. ..... 34/11; 34/179; 34/1 W; 34/39

[58] Field of Search ..... 34/179, 183, 1 W, 39, 34/11, 4

[56] References Cited

U.S. PATENT DOCUMENTS

| | | | |
|---|---|---|---|
| 3,096,165 | 7/1963 | Lane | 34/183 |
| 3,410,233 | 11/1968 | Seiler | 34/11 |
| 3,426,838 | 2/1969 | Onarheim | 34/183 |
| 4,492,039 | 1/1985 | Chao et al. | 34/39 |
| 4,734,998 | 4/1988 | Lee et al. | 34/183 |
| 4,745,691 | 5/1988 | Bradbury | 34/39 |
| 4,750,274 | 6/1988 | Erdman, Jr. et al. | 34/39 |
| 4,756,092 | 7/1988 | Anderson et al. | 34/39 |
| 4,781,933 | 11/1988 | Fraioli | 34/39 |
| 4,815,397 | 3/1989 | Minnie, Jr. | 110/223 |
| 4,827,853 | 5/1989 | Emery | 34/39 |

*Primary Examiner*—Henry A. Bennett
*Assistant Examiner*—Denise L. F. Gromada
*Attorney, Agent, or Firm*—H. Keith Hauger

[57] ABSTRACT

A sludge drying apparatus and method for dehydrating and compacting industrial and other types of sludge. This invention consists of a sludge drying box for receiving a mass of sludge and mixing same therein thoroughly by passing a series of rotational mixing forks through a series of fixed mixing forks. Simultaneously therewith, heat is applied for a timed period resultant in a significant reduction of water content and volume. The mass of industrial sludge is disposed of when the entire sludge drying apparatus is lifted vertically and by release of a latch mechanism, a mixing tub rotates by gravitational force to unload the compacted and dehydrated mass of sludge for disposal to a land fill site.

11 Claims, 4 Drawing Sheets

SLUDGE DRYING APPARATUS AND METHOD

BACKGROUND OF THE INVENTION

1. Field of the Invention

This invention relates generally to a sludge drying apparatus and method whereby industrial and other types of sludge are mixed and heated for substantial dehydrating and compacting before disposal of same.

2. Description of the Prior Art

Industrial and manufacturing plants domestically and abroad now face critical and serious environmental concerns because of large quantities of industrial sludge material which are the by-product of its processes and industrial methodology. A myriad of manufacturing operations may be cited having commonality to the referenced problem, but one particular industry facing this troublesome matter is the plating process industries. Electroplating and various types of anodizing are processes using various chemicals resultant in large quantities of hazardous waste. These, and similar treatments of metals, produce sludge having metal hydroxides which are classified as hazardous waste by the Environmental Protection Agency, being specifically number "F006". Presently, sludge is pumped through filter presses only capable of reducing same to a 75% water content. This is the last step in the normal procedure prior to placing the sludge in a dumpster and hauling same to an authorized landfill sight.

Fraioli U.S. Pat. No. 4,781,933 entitled "Infrared Dehydrator Unit for Minced Fish" is a gas-fired infrared dehydrator having rotating paddles applicable to a food product like fish. A second infrared heater application is seen in Minnie, Jr. U.S. Pat. No. 4,815,397 for purposes of drying sludge. Sludge dryers are illustrated in U.S. Pat. No. 4,745,691 to Bradbury, U.S. Pat. No. 4,756,092 to Anderson, and U.S. Pat. No. 4,827,853 to Emery.

Today's environmental priorities and concerns demand that manufacturing and industrial institutions have methods and processes that are geared to a higher capability of processing industrial waste product and sludge for disposal. The invention presented in this application meets and exceeds this criteria.

SUMMARY OF THE INVENTION

It is, therefore, an object of the present invention to provide a sludge drying apparatus and method that represents a substantial improvement over the prior art in its capability to dehydrate and compact industrial sludge.

It is a further object of this invention to provide a sludge drying apparatus and method that is capable of reducing the water content of sludge from approximately 75% to 35% and concurrently therewith decreases the sludge volume by approximately 66% reducing the amount of sludge that must be hauled and deposited into landfills.

It is a further object of the subject invention to provide a sludge drying apparatus and method that is capable of mixing sludge to assure even drying.

It is a further object of the subject invention to provide a sludge drying apparatus and method that is capable of simple operation by not more than one semi-skilled workman.

It is a further object of the subject invention to provide a sludge drying apparatus and method that is reasonably priced and affordable to all sized businesses and manufacturing endeavors regardless of financial means.

It is a further object of the subject invention to provide a sludge drying apparatus and method that is safe to workmen operating same and others in its immediate vicinity.

It is a further object of the present invention to provide a sludge drying apparatus and method that is versatile and capable of being easily transported throughout any given manufacturing plant.

It is a further object of the present invention to provide a sludge drying apparatus and method that is easily maintained and cleaned after use.

It is a further object of the present invention to provide a sludge drying apparatus and method that has an overall positive effect on the environment internationally.

More specifically, the present invention is a sludge drying apparatus for receiving and drying industrial and other sludge comprising a sludge drying box having a mixing tub allowing for containment of said industrial and other sludge; a mixing means for agitation of said industrial and other sludge; a heating means for applying heat to said industrial and other sludge while in rotational motion within said mixing tub; a disposing means consisting of a pivoting means allowing said mixing tub to be positioned for unloading said industrial and other sludge; a power drive means for operation of said mixing means and a control means for operation of said sludge drying apparatus.

These objects, as well as other objects and advantages of the present invention, will become apparent from the following description, in reference to the illustrations appended hereto.

BRIEF DESCRIPTION OF THE DRAWINGS

For a better understanding of the invention, reference may be had to the accompanying drawings, in which.

DESCRIPTION OF PREFERRED EMBODIMENTS

Figure 1:
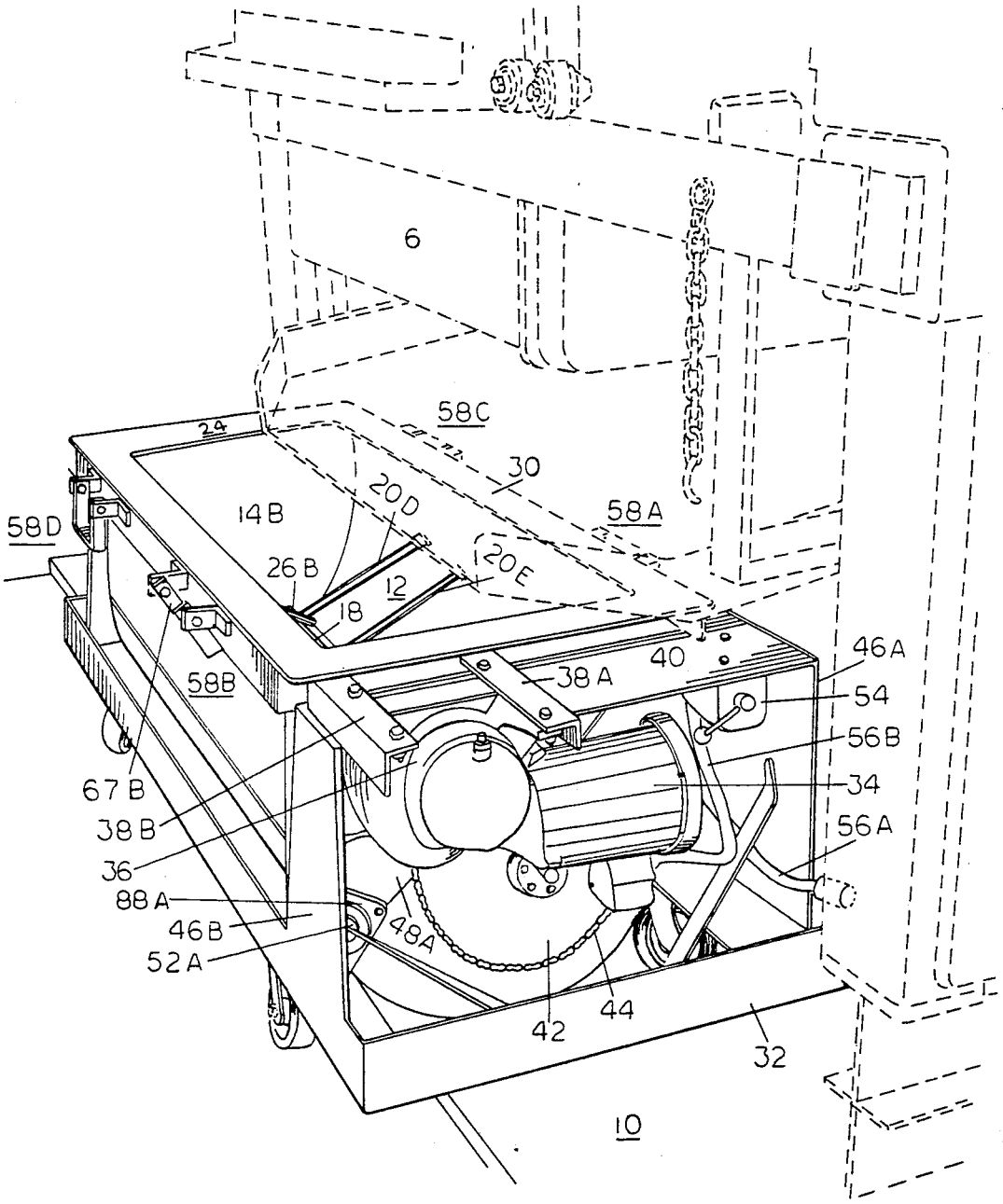
FIG. 1 is a perspective view of a sludge drying box being one of the major components of a sludge drying apparatus.
Figure 2:
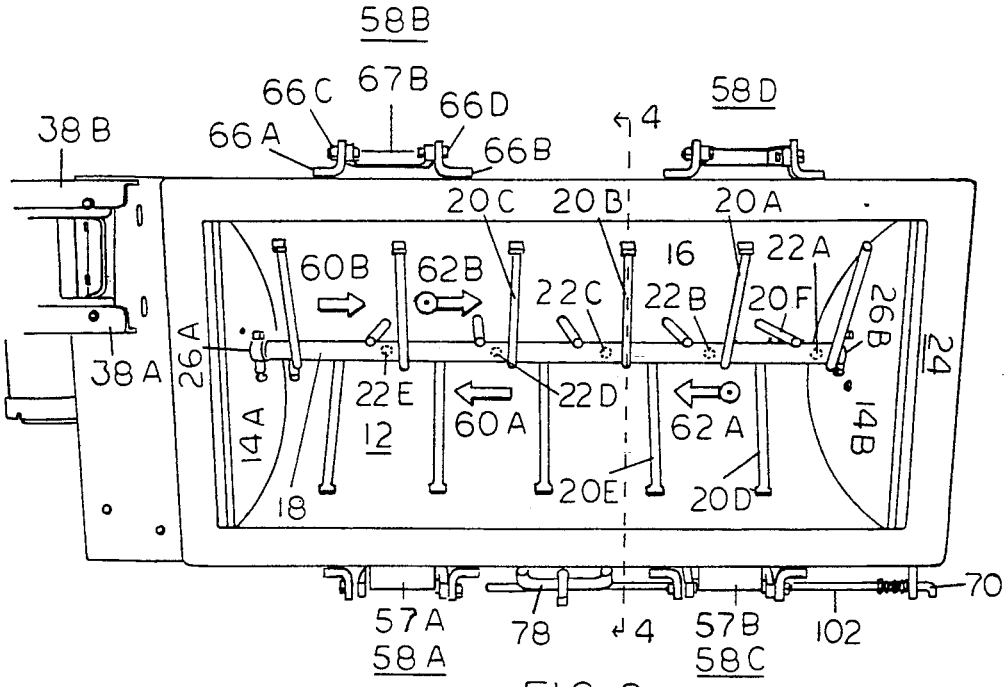
FIG. 2 is a top view of a sludge dryer box showing a mixing tub and one of its essential elements, a mixing shaft.
Figure 3:
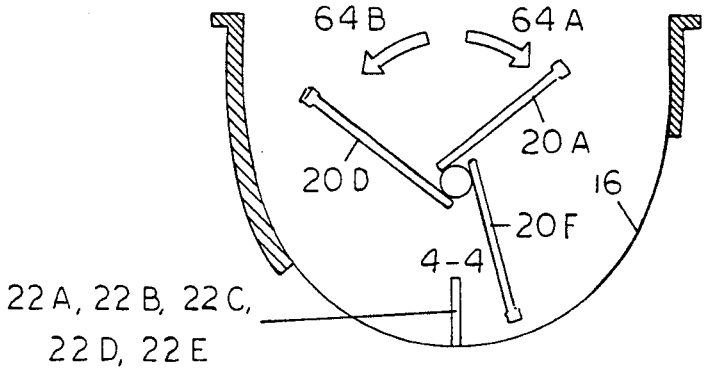
FIG. 3 is a cross-sectional side view of a mixing tub, mixing shaft and attached mixing forks.
Figure 4:
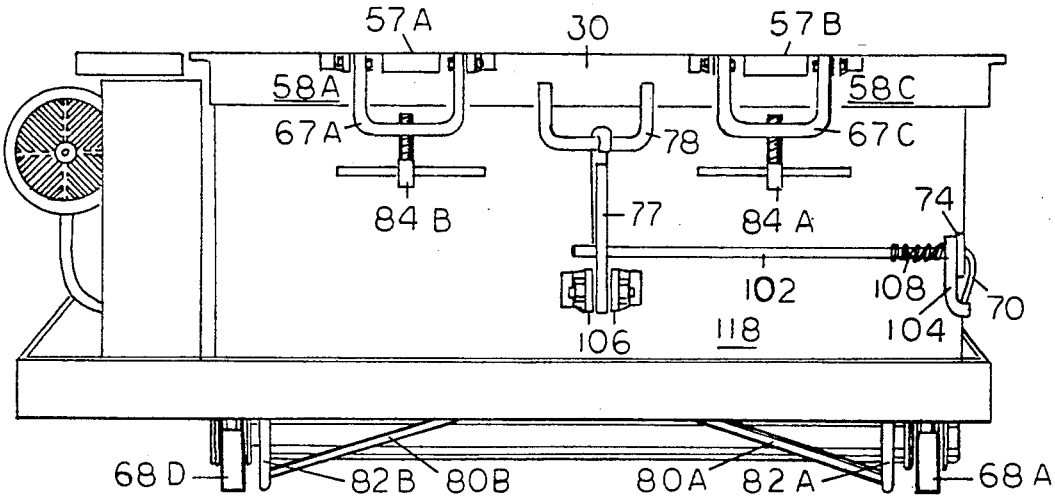
FIG. 4 represents a rear elevational view of a sludge dryer box.
Figure 5:
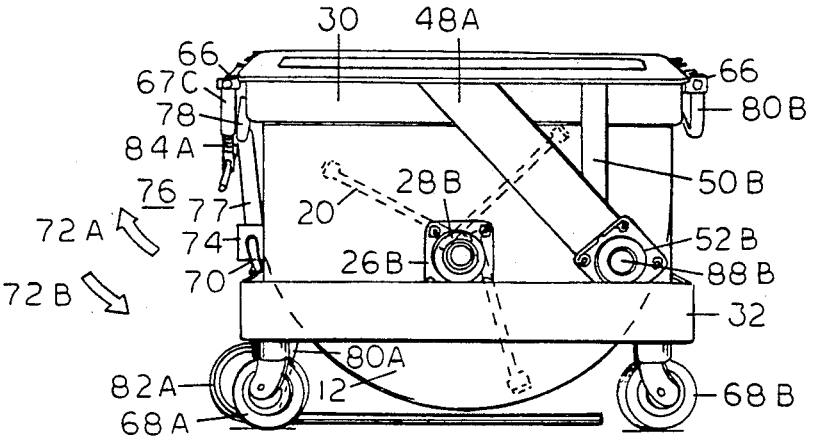
FIG. 5 is a side elevational view of a sludge dryer box.

Referring to the drawings, FIG. 1 represents a perspective view of a sludge dryer box 10 being a main component of a sludge drying apparatus 8. Industrial and other types of sludge mass are loaded from a filter press 6 into a mixing tub 12, having mixing tub right side panel 14*a* and mixing tub left side panel 14*b* connected by mixing tub parabolic plane surface 16. Sludge is agitated by means of a mixing shaft 18 having a plurality of mixing forks like 20*a*, 20*b*, 20*c*, 20*d*, 20*e*, and 20*f* being aligned in three separate rows 120 degrees from each other. The mixing tub 12 further consists of a plurality of stationary mixing pins 22*a*, 22*b*, 22*c*, 22*d* and 22*e*, which are fastened vertically to a lowermost point of mixing tub parabolic surface 16. Mixing tub 12 is supported by mixing tub support means 24 and mixing shaft 18 is supported by mixing shaft support means right 26*a* and mixing shaft support means left 26*b*, consisting in part respectively of mixing shaft bearing means right 28*a* (not shown) and mixing shaft bearing means left 28*b*. Mixing tub support means 24 further consists of upper mixing tub frame member 30 and lower mixing tub frame member 32 making mixing tub 12 rigid. Drive means 34 shown in FIG. 1 powers mixing shaft 18 to rotate throughout mixing tub 12 containing a sludge mass. Gear reducing means 36 controls the speed of mixing shaft 18 and allows mixing shaft 18 to rotate in clockwise motion 64*a* or counter-clockwise motion 64*b* as shown in FIG. 3. Power drive means 34 is supported by power drive means support right 38*a* and power drive means support left 38*b*. Drive means housing member 40 protects power drive means 34, gear reducing means 36 and other indicated components from dirt, dust, sludge and debris. Power drive means 34 is connected by drive means sprocket chain 44 to drive means sprocket 42 for purposes of accomplishing various speeds, clockwise motion 64*a* and counter-clockwise motion 64*b*. Power drive means 34, gear reducing means 36, drive means sprocket 42, drive means sprocket chain 44 and the other relevant components are further protected from dirt, dust, sludge and debris by chain guard member right 46*a* and chain guard member left 46*b* which is a safety feature of sludge drying apparatus 8 in the event of any failure of the above-described moving parts.

Figure 7:
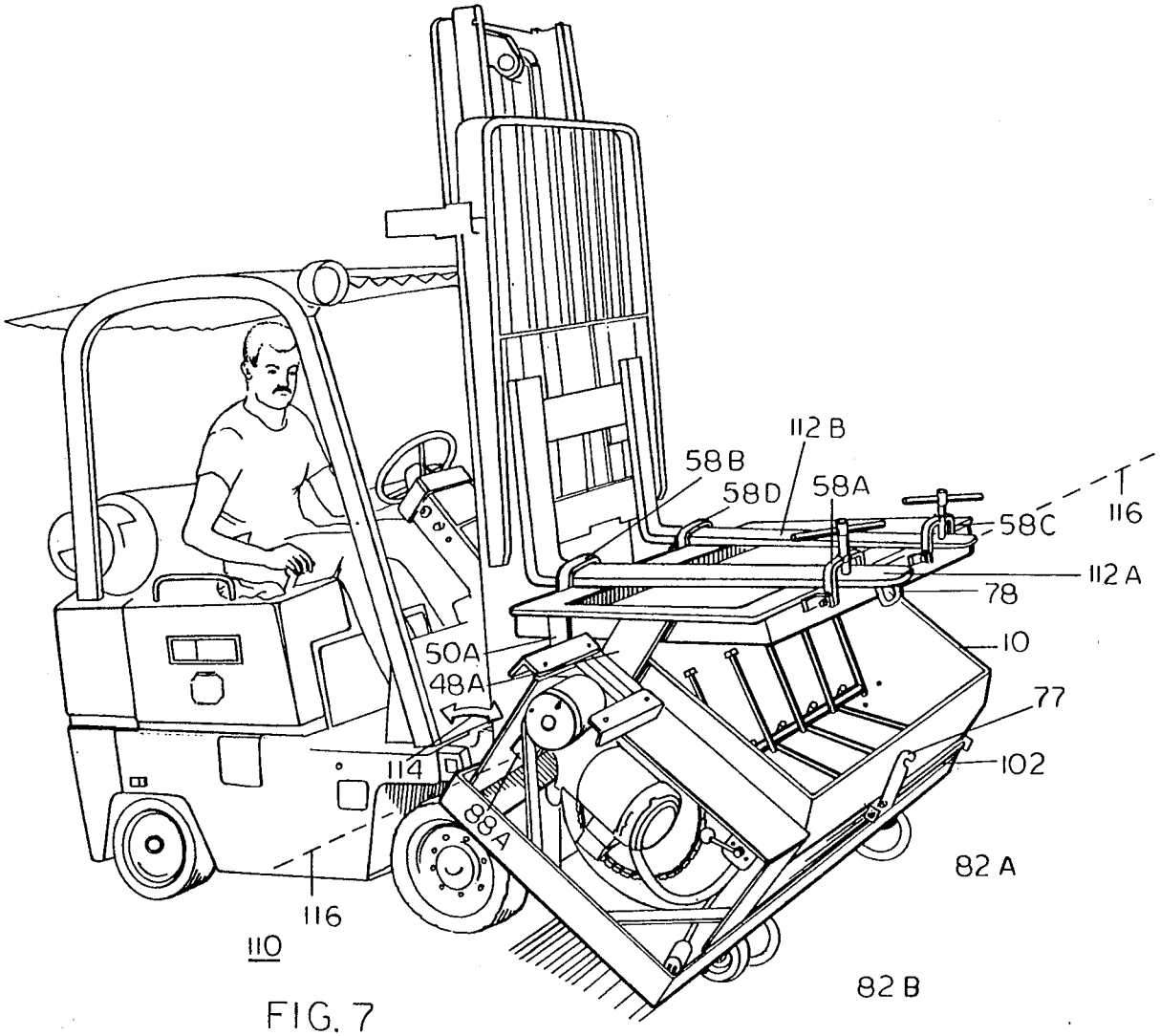
FIG. 7 is a perspective view of a lifting means like a fork lift vertically raising a sludge dryer box for disposing of industrial and other sludge.

Right dumping arm 48*a* shown in FIGS. 1 and 7 is fastened to mixing tub support means 24 and likewise left dumping arm 48*b* is fastened to mixing tub support means 24. Right dumping arm 48*a* and left dumping arm 48*b* rotate about right dumping arm bearing 52*a* and left dumping arm bearing 52*b* respectively. Right dumping arm 48*a* is made rigid and given further support by right dumping arm support 50*a*. Left dumping arm 48*b* is made rigid and given further support by left dumping arm support 50*b*.

Lifting loop means are illustrated in FIGS. 1, 2, 4, 5, 6 and 7 and are labeled as lifting loop means right/rear 58*a*, lifting loop means right/front 58*b*, lifting loop means left/rear 58*c*, and lifting loop means left/front 58*d*. There are a plurality of lifting loop means brackets like right loop bracket right/front 66*a* and left loop bracket right/front 66*b*. Right loop bracket right/front 66*a* and left loop bracket right/front 66*b* provide support for lifting loop bracket right/front 66*b* provide support for lifting loop means 58*b*, and a similar lifting means bracket supports lifting loop means 58*a*, 58*c* and 56*d*. Loop bolt/nut means right/front 66*c* and 66*d* fasten to lifting loop 67*b* and likewise for other lifting loops 67*a*, 67*c* and 67*d*.

Turning means 70 may be rotated in turning means motion clockwise 72*a* or turning means motion counter-clockwise 72*b* to respectively either release or lock locking means 76. Locking means 76 determines whether mixing tub 12 is free to rotate or is fixed rigid to sludge dryer box 10. Furthermore, locking means 76 consists of locking hook 77 supported by locking hood support 106 which latches to locking loop 78 to place mixing tub 12 in the rigid fixed position to sludge dryer box 10. Turning means support 74 supports turning means 70 on the rear side 118 of sludge dryer box 10.

There are a plurality of leg supports 80*a* and 80*b* whereby a plurality of bumper supports 82*a* and 82*b* are attached which allow mixing tub 12 to pivot by gravitational force on an imaginary latitudinal axis of rotation 116 as shown in FIG. 7. Lifting means 110 (generally a forklift) causes vertical motion to sludge dryer box 10 by placing lifting means teeth 112*a* and 112*b* (generally forklift teeth) through a plurality of lifting loops 67*a*, 67*b*, 67*c* and 67*d*. Turning means 70 is rotated such that slide bar means 102 releases locking means 76 allowing mixing tub 12 to move through mixing tub angle of rotation 114 for disposing of sludge waste after it has been dried and compacted in sludge box 10 which has been placed under heating means 90.

Fork truck support tongues 57*a* and 57*b* provide additional stability to sludge dryer box 10 when under vertical lift by lifting means 110. Right tie down means 84*a* and left tie down means 84*b* stabilize lifting means teeth 112*a* and 112*b* to prevent movement of sludge dryer box 10. Imaginary latitudinal axis of rotation motion 116 of mixing tub 12 is structurally right pin member 88*a* and left pin member 88*b*.

After unloading sludge from mixing tub 12, sludge dryer box 10 is lowered to the ground and mixing tub 12 is secured to sludge dryer box 10 through use of keeper pin 104 and return spring 108.

Mixing shaft 18 may be removed for cleaning and maintenance by application of a force horizontally shown as mixing shaft motion right 60*b* and then application of a vertical force shown as mixing shaft motion vertical up 62*b*. Likewise, mixing shaft 18 may readily be replaced into mixing tub 12 through mixing shaft motion vertical down 62*a* and by application of a force horizontally shown as mixing shaft motion left 60*a* towards mixing shaft support means right 26*a*.

Sludge dryer box 10 may readily be moved throughout an industrial plant through use of a plurality of roller means 68*a*, 68*b*, 68*c*, and 68*d*.

Figure 6:
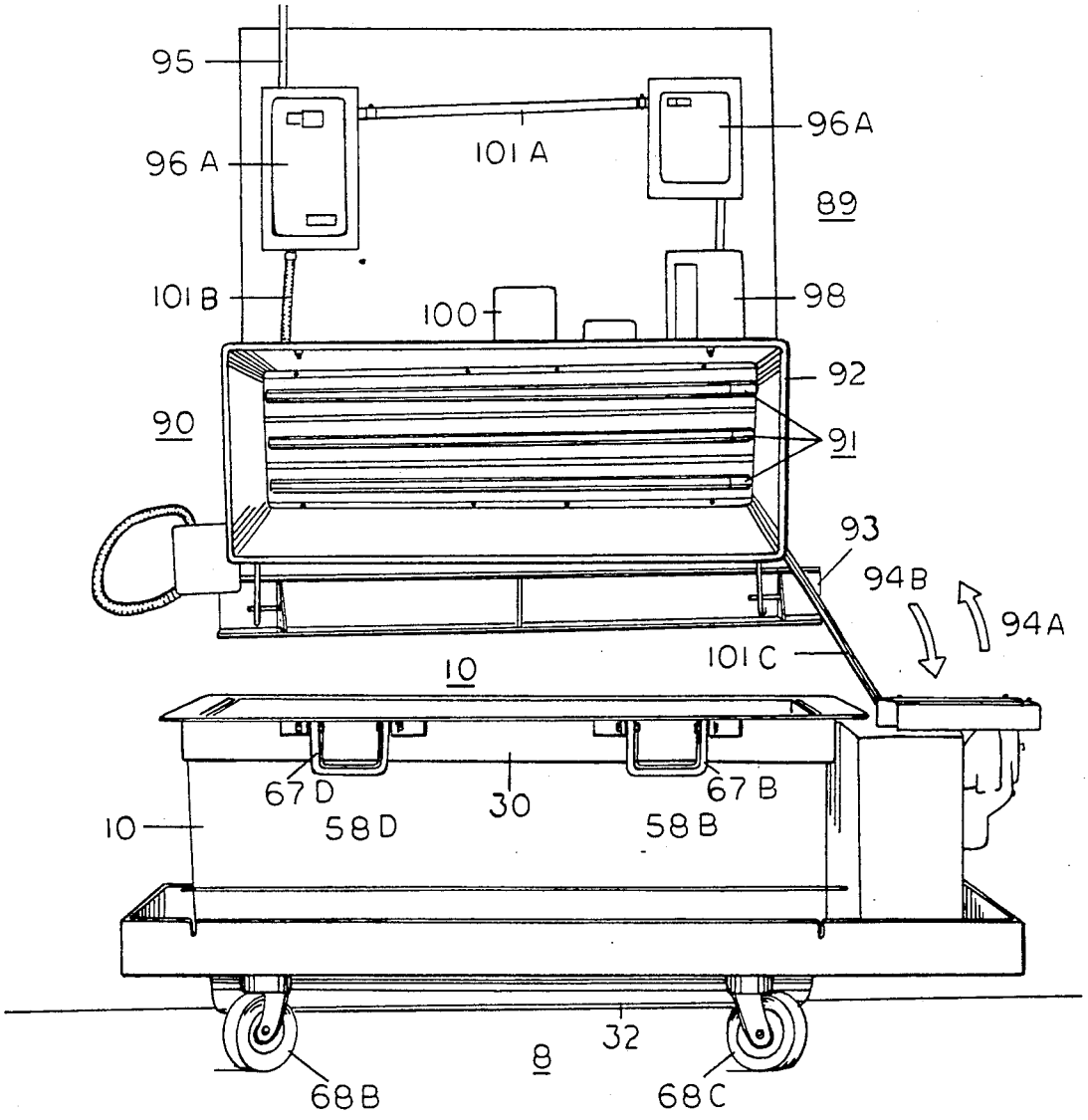
FIG. 6 is a front elevational view of a sludge dryer apparatus including as its essential components a sludge dryer box, a heating means and an electrical control panel.

The aforesaid clockwise motion 64*a* and counter-clockwise motion 64*b* of mixing shaft 18 are accomplished by switch means 54. Power supply lead 56*a* connects switch means 54 to electrical power source input 95 and likewise switch/motor lead 56*b* connects power drive means 34 to switch means 54. Electrical control panel 89 is shown in FIG. 6. Heating means 90 is located directly over sludge dryer box 10 for drying sludge mass contained in mixing tub 12 prior to disposing. Heating means 90 may be rotated through pivot means rotational motion 94*a* to a vertical position or 94*b* to a horizontal position. Pivot means rotational motion 94*b* (the horizontal position) is for purposes of applying electromagnetic coil means 91 enclosed by heating shield means 92 to heat a sludge mass in mixing tub 12. Shield pivot means 93 structurally permits pivot means rotational motion 94*a* and 94*b*.

Electric control panel 89 further consists of electrical power source input 95 which splits to disconnect switch 96*a* to control heating means 90 and disconnect switch 96*b* to control mixing means 11. Control switch 98 functions further to control drive means 34. Timing means 100 determines the time period for mixing a sludge mass in mixing tub 12. Connecting leads 101*a*, 101*b* and 101*c* are shown in FIG. 6 and electrically connect the various components shown thereon.

In accordance with the provisions of the Patent Statutes, we have explained the principle and operation of our invention and have illustrated and described what we consider to represent the best embodiment thereof.

I claim:

1. A sludge drying apparatus for receiving and drying industrial and other sludge comprising:

a sludge drying box having a mixing tub allowing for containment of said industrial and other sludge;

a mixing means for agitation of said industrial and other sludge;

a heating means for applying heat to said industrial and other sludge while in rotational motion within said mixing tub;

a disposing means consisting of a pivoting means allowing said mixing tub to be positioned for unloading said industrial and other sludge, wherein said pivoting means consists of a first pivotal dumping arm located to the outside of a first end surface of said mixing tub and a second dumping arm located to the outside of a second end surface of said mixing tub, said first dumping arm and said second dumping arm extending to a pivotal point on a lower frame member of said sludge drying box;

a power drive means for operation of said mixing means;

a control means for operation of said sludge drying apparatus.

2. A sludge drying apparatus according to claim 1, wherein said disposing means consist of a plurality of lifting loop means fastened to an upper frame member of said sludge drying box to accommodate a lifting means capable of giving vertical rise to said sludge drying box and allowing said mixing tub to rotate by gravitational forces for said unloading.

3. A sludge drying apparatus according to claim 1:

wherein said sludge drying box consists of an open cavity having a plurality of joined surface members fastened to said lower frame member and an upper frame member of said sludge drying box;

wherein said mixing means is operated by said power drive means which functions to give rotational motion to a mixing shaft mounted laterally within said mixing tub, said mixing shaft having fastened perpendicular and axially thereto a plurality of mixing forks, said mixing forks interspersed with a plurality of stationary mixing pins fastened vertically at a lowermost point of a bottom surface area of said mixing tube for evenly and constantly mixing said industrial and other sludge;

wherein said heating means consists of an electromagnetic coil means fastened inside a heating shield means for directing infrared heat to said industrial and other sludge in said mixing tub;

wherein said power drive means is capable of said rotational motion consisting of clockwise rotary motion and counter-clockwise rotary motion for said agitation of said industrial and other sludge;

wherein said control means consists of a plurality of switch means for operation for said heating means and said mixing means through said power drive means receiving energy from a power source input.

4. A sludge drying apparatus according to claim 1:

wherein said sludge drying box consists of an open cavity having a plurality of joined surface members fastened to said lower frame member and an upper frame member of said sludge drying box;

wherein said mixing means is operated by said power drive means which functions to give rotational motion to a mixing shaft mounted laterally within said mixing tub, said mixing shaft having fastened perpendicular and axially thereto a plurality of mixing forks, said mixing forks interspersed with a plurality of stationary mixing pins fastened vertically at a lowermost point of a bottom surface area of said mixing tub for evenly and constantly mixing said industrial and other sludge;

wherein said heating means consists of an electromagnetic coil means fastened inside a heating shield means for directing infrared heat to said industrial and other sludge in said mixing tub;

wherein said disposing means consists of a plurality of lifting loop means fastened to an upper frame member of said sludge drying box to accommodate a lifting means capable of giving vertical rise to said sludge drying box and allowing said mixing tub to rotate by gravitational forces for said unloading;

wherein said power drive means is capable of said rotational motion consisting of clockwise rotary motion and counter-clockwise rotary motion for said agitation of said industrial and other sludge;

wherein said control means consists of a plurality of switch means for operation of said mixing means through said power drive means and said heating means by receiving energy from a power source input.

5. A sludge drying apparatus for receiving and drying industrial and other sludge comprising:

a sludge drying box having a mixing tub being an open cavity consisting of an elongated parabolic plane surface, a first end surface conforming in shape in said elongated parabolic plane surface, and a second end surface conforming in shape to said elongated parabolic plane surface allowing for containment of industrial and other sludge;

a mixing means for agitation for said industrial and other sludge by causing rotary motion to a mixing shaft mounted laterally within said mixing tub, said mixing shaft having fastened perpendicular and axially thereto a plurality of mixing forks, said mixing forks interspersed with a plurality of stationary mixing pins fastened vertically at a lowermost point of said elongated parabolic plane surface of said mixing tub for evenly and constantly mixing said industrial and other sludge;

a heating means for applying heat to said industrial and other sludge while under power of said power drive means in said rotary motion, said heating means consisting of an electromagnetic coil means fastened inside a heating shield means for directing infrared heat to said industrial and other sludge in said mixing tub;

a disposing means consisting of a first pivotal dumping arm located parallel to said first end surface and a second pivotal dumping arm located parallel to said second end surface, said first parallel dumping arm and said second parallel dumping arm extending from a lower frame member to an upper frame member, said upper frame member having a plurality of lifting loop means fastened thereto to allow a lifting means to give vertical rise to said sludge drying box whereupon, by release of a locking means, and mixing tub is capable of rotating to a disposing position by gravitational forces for unloading said industrial and other sludge;

a control means for control and operation of said sludge drying apparatus consisting of a plurality of switch means for operation of said mixing means through said power drive means and said heating means by receiving energy from a power source input.

6. A sludge drying apparatus according to claim 5, wherein said power drive means controlled by a first switch means is capable of causing said rotary motion to said shaft in a clockwise direction and in a counter-clockwise direction.

7. A sludge drying apparatus according to claim 5, wherein said locking means consists of a locking loop fastened to said upper frame member, a locking hook supported by a locking hook support causing said locking hook to rotate about said locking hook support into a lock mode securing said mixing tub to said sludge drying box at said upper frame member and upon release of said locking hook from said locking loop and unlocked mode is established allowing said lifting means to cause said mixing tube to rotate into said disposing position for unloading said industrial and other sludge.

8. A method for drying industrial and other sludge comprising the steps of:

loading a mass of industrial and other sludge into a sludge drying box;

mixing said industrial and other sludge in said sludge drying box by rotation of a mixing shaft attached laterally within a mixing tub for rotary motion of said industrial and other sludge wherein said mixing shaft has a plurality of mixing forks fastened perpendicular and axially to said mixing shaft, said mixing forks being interspersed with a plurality of stationary mixing pins fastened vertically at a lowermost point of a bottom surface area of said mixing tub;

simultaneously with said mixing of industrial and other sludge heating said industrial and other sludge over a timed period until said industrial and other sludge reaches dehydrated and compact status;

disposing said industrial and other sludge by lifting said sludge drying box vertically and releasing said mixing tub for pivoting to a disposing position by gravitational force for unloading said industrial and other sludge.

9. The method of claim 8 in which the disposing step consists of lifting said sludge drying box by inserting a lifting means into a plurality of lifting loop means vertically attached to a frame member, said frame member giving strength and rigidity to said sludge drying box.

10. The method of claim 9 in which the disposing step further consists of rotating said sludge drying box on a ground surface by providing a plurality of bumper pivots mounted to a lower frame member of said sludge drying box for stabilizing said sludge drying box during said unloading.

11. The method of claim 9 in which the mixing step further consists of agitating said industrial and other sludge by rotating said mixing forks between said plurality of stationary mixing pins for uniformly exposing said industrial and other sludge during said heating step to a heating source resultant in evenly and constantly mixing said industrial and other sludge for said dehydrated and compact status to be most effective.

* * * * *